United States Patent [19]

Lew et al.

[11] Patent Number: 5,029,669

[45] Date of Patent: Jul. 9, 1991

[54] ROPE CLIMBING AND SLIDING DEVICE

[76] Inventors: Hyon S. Lew; Yon K. Lew; Hyok S. Lew, all of 7890 Oak St., Arvada, Colo. 80005

[21] Appl. No.: 467,487

[22] Filed: Jan. 19, 1990

Related U.S. Application Data

[63] Continuation-in-part of Ser. No. 287,132, Dec. 21, 1988, abandoned, which is a continuation-in-part of Ser. No. 938,389, Dec. 4, 1986, Pat. No. 4,793,436.

[51] Int. Cl.[5] ..... A62B 1/08

[52] U.S. Cl. ..... 182/42; 182/193; 182/5

[58] Field of Search ..... 182/42, 5-9, 182/133-136, 192, 193, 71, 72; 188/65.1-65.5

[56] References Cited

U.S. PATENT DOCUMENTS

| | | | |
|---|---|---|---|
| 315,025 | 4/1885 | Heath | 182/135 |
| 2,554,292 | 5/1951 | Brown | 403/81 X |
| 2,970,357 | 2/1961 | Pinson et al. | 24/115 J |
| 4,580,658 | 4/1986 | Brda | 182/5 |
| 4,846,075 | 7/1989 | Tupper | 182/5 |

FOREIGN PATENT DOCUMENTS

| | | | |
|---|---|---|---|
| 4524 | 7/1878 | Fed. Rep. of Germany | 182/135 |

*Primary Examiner*—Alvin C. Chin-Shue

[57] ABSTRACT

A device for ascending and descending following a vertically disposed rope comprises a handle assembly including a pair of handles, a stirrup asssembly including a pair of foot-holds and a harness depending from the handle assembly, wherein the handle assembly attached to the rope in a sliding relationship grabs the rope when the pair of handles are pulled down and the stirrup assembly attached to the rope in a sliding relationship grabs the rope when the pair of foot-holds are stepped on; whereby a person wearing the harness climbs the rope by repeating the movements of pulling up the stirrup assembly by bending the knees while pulling down the pair of handles and then pushing up the handle assembly while standing up on the pair of foot-holds, or slides down on the rope at a controlled speed by exerting a required amount of braking applied by means of the handle assembly and/or the stirrup assembly.

20 Claims, 2 Drawing Sheets

ROPE CLIMBING AND SLIDING DEVICE

This application is a continuation-in-part to patent application Ser. No. 07/287,132 entitled "Rope Climbing Device" filed Dec. 21, 1988, now abandoned that is a continuation-in-part to patent application Ser. No. 938,389 entitled "Push-Pull Sky-Ride Vertical Mobility Device" filed on Dec. 4, 1986, that is now U.S. Pat. No. 4,793,436.

BACKGROUND OF THE INVENTION

There is need and demand for an inexpensive light weight portable or semi-portable device for ascending and descending the walls of the high rise buolings, tall rigs, trees and deep wells, etc. that can be deployed at the instant of need and is usable by average people without requiring training or extraordinary physical fitness, as such a device serves a very useful purpose in case of fire on a high rise building, emergency rescue, exploration, recreation, etc.

BRIEF SUMMARY OF THE INVENTION

The primary object of the present invention is to provide a rope climbing and sliding device comprising a pair of handles and a harness securable to the torso of a person that depends from the pair of handles, wherein the pair of handles flanking a vertically disposed rope therebetween in a sliding relationship and pivotably supported by a supporting member sliding on the rope pivot towards one another and grab the rope in a pinching relationship when the pair of handles are pulled down or the harness depending from the pair of handles supports the body weight of a person.

Another object is to provide the pair of handles grabbing or sliding on the rope depending on the magnitude of the force pulling down the pair of handles, which can be attached to the rope or removed therefrom.

A further object is to provide a pair of foot-holds flanking a vertically disposed rope therebetween in a sliding relationship and pivotably supported by a supporting member sliding on the rope, wherein the pair of foot-holds pivot towards one another and grab the rope in a pinching relationship when the body weight of a person is supported by the feet respectively resting on the pair of foot-holds, which pair of foot-holds are usable in conjunction with the combination of the pair of handles and the harness, or with the pair of handles only.

Yet another object is to provide the pair of foot-holds grabbing or sliding on the rope depending on the magnitude of the force pressing down the pair of foot-holds, which can be attached to the rope or removed therefrom.

Yet a further object is to provide a escaping device from an elevated structure that comprises the pair of handles and the harness, by which a person can descend on a vertically disposed rope at a safe speed.

Still another object is to provide a rope climbing and sliding device comprising the combination of the pair of handles and the harness, and the pair of foot-holds, or the pair of the handles and the pair of footholds, which enables a person to ascend or descent easily and safely following the vertically disposed rope.

These and other objects of the present invention will become clear as the description thereof progresses.

BRIEF DESCRIPTION OF THE FIGURES

The present invention may be described with a greater clarity and specificity by referring to the following figures.

DESCRIPTION OF THE ILLUSTRATED EMBODIMENTS

Figure 1:
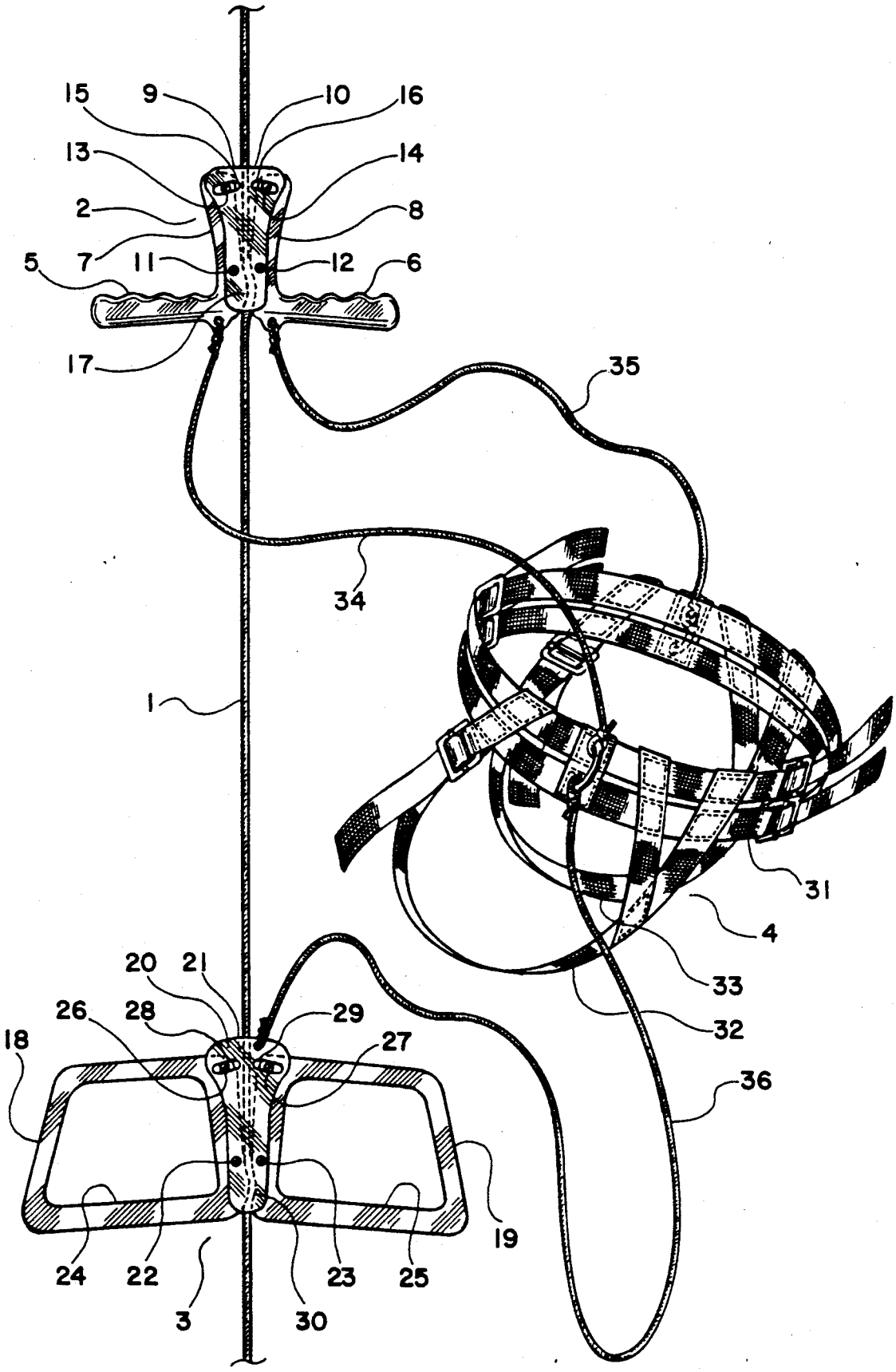
FIG. 1 illustrates a perspective view of an embodiment of the rope climbing and sliding device comprising a pair of handles, a harness and a pair of foot-holds, while other embodiment may comprise the pair of handles and the harness only, or the pair of handles and the pair of foot-holds only.

In FIG. 1 there is illustrated an embodiment of the rope climbing and sliding device constructed in accordance with the principles of the present invention, which device provides a vertical mobility following a vertically disposed rope or cable or rod 1 depending from an elevated structure, which rope climbing and sliding device comprises a handle assembly 2, a stirrup assembly 3 and a harness 4. The handle assembly 2 includes a pair of handles 5 and 6 disposed on two opposite sides of the rope 1 and respectively supported by the angled extensions 7 and 8. The angled extensions 7 and 8 are respectively supported by a pair of planar supports 9 and 10 (the element 10 is hidden behind the element 9 and, consequently it is not visible) flanking the rope 1 therebetween in a sliding relationship by a pair of pivoting joints 11 and 12 disposed close to the roots of the handles 5 and 6, while the extremities of the angled extensions 7 and 8 respectively include guide pins 13 and 14 which follow two slotted guide holes 15 and 16 included in the planar support 9 and 10. The combination of the angled extremities of the handles 5 and 6 provides a curved passage 17 for the rope 1, through which the rope 1 slides freely as long as the pair of handles 5 and 6 are not pulled down. The stirrup assembly 3 includes a pair of foot-holds 18 and 19 disposed on two opposite sides of the rope 1 and pivotably supported by a pair of planar supports 20 and 21 flanking the rope 1 by a pair of pivoting joints 22 and 23, respectively, which pivoting joints 22 and 23 are respectively disposed close to the foot supports 24 and 25. The foot-holds 18 and 19 respectively include guide pins 26 and 17, which follow two slotted guide holes 28 and 29 included in the planar supports 20 and 21. The combination of the inner extremities of the two foot supports 24 and 25 provides a curved passage 30 for the rope 1, through which the rope 1 slides freely as long as the two foot supports are not stepped on. The harness 4 includes a waist strap 31 and a pair of thigh straps 32 and 33. A pair of ropes 34 and 35 respectively secured to the two opposite sides of the waist strap 30 are secured to the inner extremities of the handles 5 and 6, respectively. As an alternative design, the pair of ropes 34 and 35 may be secured to the outer extremities of the handles 5 and 6, respectively. A tethering rope 36 prevents the stirrup assembly 3 from separating from the combination of the handle assembly 2 and the harness 4 beyond a distance predetermined by the length of the tethering rope 36.

A person wearing the harness 4 with the waist strap 31 secured around the lower torso and the thigh straps 32 and 33 secured around the thighs is able to climb the rope 1 with ease, or slide down or remain suspended in midair effortlessly. When the person wearing the harness 4 bends one's knee to pull up the stirrup 3, while pulling down the handles 5 and 6 by hands and/or resting one's body weight on the harness 4, the stirrup 3 slides up following the rope 1 as the handle 2 grabbing the rope 1 supports the full body weight of the person. When the person stands up on the stirrup 3 after pulling up the stirrup 3 by bending the knees, the stirrup 3 grabs the rope 1 as the rope 1 passing through the curved passage 30 is pinched and, consequently, the person can push up the handle 2 following the rope 1. By repeating the above-mentioned movements comprising pulling up the stirrup 3 by bending the knees while pulling down the handle 2, and pushing up the handle 2 by standing up on the stirrup 3, the person wearing the harness can climb the rope 1 effortlessly and safely. In order to slide down on the rope, one pushes the two foot-holds 18 and 19 towards one another with the soles of the shoes at the sections where the guide pins 26 and 27 are located while standing on the stirrup 3 ad illustrated in FIG. 3, wherein the person may partially or completely reduce the pulling force on the handle 2 or compress the angled members 7 and 8 of the handle 2 towards one another as shown in FIG. 4 in controlling the braking applied by the stirrup 3 and/or handle 2, that controls the descending speed of the person in sliding action. Of course, one can descend by repeating the movements employed in climbing in reversing direction. The primary purpose of the tether cord 36 is to prevent the stirrup 3 from dropping away from the person.

The handle 2 and the stirrup 3 must be included in the device used for climbing and sliding on the rope 1 or climbing the rope only, as the harness 4 is not a strictly necessary element for the climbing up as well as well as the sliding down. Therefore, another embodiment of the rope climbing and sliding device may include the handle 2 and the stirrup 3 only without the harness 4, wherein the stirrup 3 may be tethered to the handle 2. When the device is exclusively used for sliding down on the rope 1 without requiring climbing. which is most important application of the present invention as it provides a highly economic and efficient escape system from a high rise building in case of emergency such as a fire or terrorist attack, the device may include the handle 2 and harness 4 only without the stirrup, wherein the harness 4 may be simpler version such as a sling or a sack with two leg holes, that depends from the handle 2, as the handle 2 alone can provide a sufficient amount of the braking to maintain the descending speed within a safe range. In another embodiment of the device used for descending only, the device may include the handle 2 and stirrup 3 only without the harness 4, wherein the handle 2 and stirrup 3 may be connected rigidly by an elongated member or flexibly by tethering rope.

Figure 2:
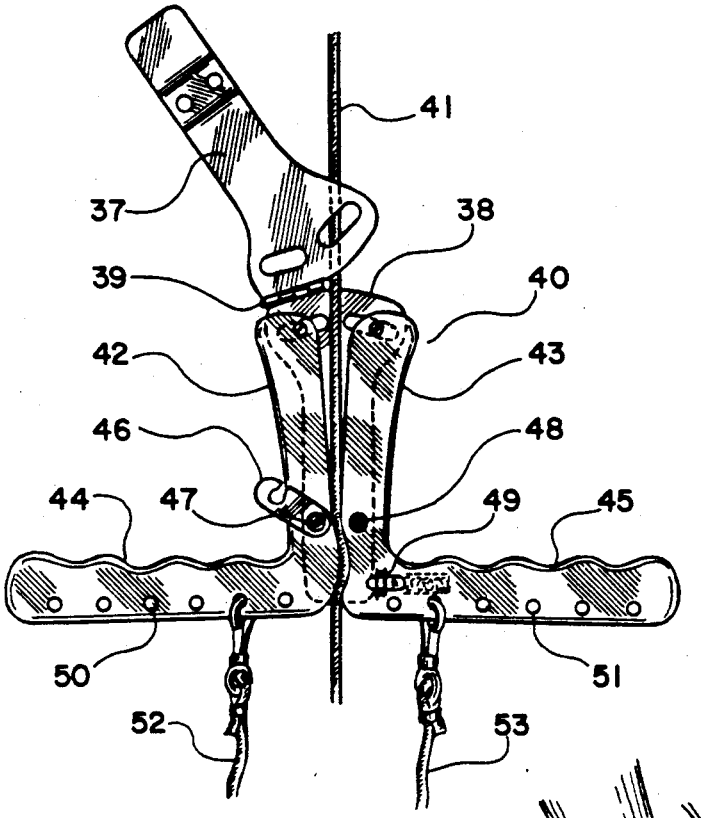
FIG. 2 illustrates a pair of handles included in the rope climbing and sliding device, that can be attached to or removed from the rope.

In FIG. 2 there is illustrated a modified version of the handle 2 shown in FIG. 1, which modified version has one of the two planar supports 37 connected to other planar support 38 by a hinged joint 39, that allows the planar support 37 to be lifted up and opens up one side of the rope passage, whereby the handle assembly 40 can be attached to the rope 41 or removed therefrom. The planar support 39 supports the pair of angled members 42 and 43 of the handles 44 and 45 in a pivoting and retaining relationship and, consequently, the primary function of the planar support 37 is to confine the rope 41 within the rope passage intermediate the two angled members 42 and 43 and intermediate the two planar supports 37 and 38 when the planar support 37 is closed. There is a dual locking mechanism comprising a latch 46 pivotably supported by one of the two pivoting joints 46 and 47, that latches on the other of the two pivoting joints, and a spring biased slidable lock 49 that keeps the planar support 37 at a closed position. The latch 47 that keep the rope 41 within the rope passage must be closed before closing the planar support 37 that becomes automatically locked in the closed position by the lock 49. The pair of handles 44 and 45 include a plurality of holes 50 and 51 distributed following the lengths thereof for anchoring the ropes 52 and 53 securing the harness, sling or sack to the handle assembly in such a way that a proper amount of braking is automatically exerted by the handle 40 that keeps the descending speed within a safe limit, when the body weight of the person wearing the harness, sling or sack is supported by the pair of ropes 52 and 53. By pulling down the pair of handles 44 and 45 and thus shifting the support of the body weight from the pair of ropes 52 and 53 to the arms pulling down the pair of handles, the person can exert an additional braking by the handle 40 that further slows down the descending speed or brings down to a complete stop.

Figure 3:
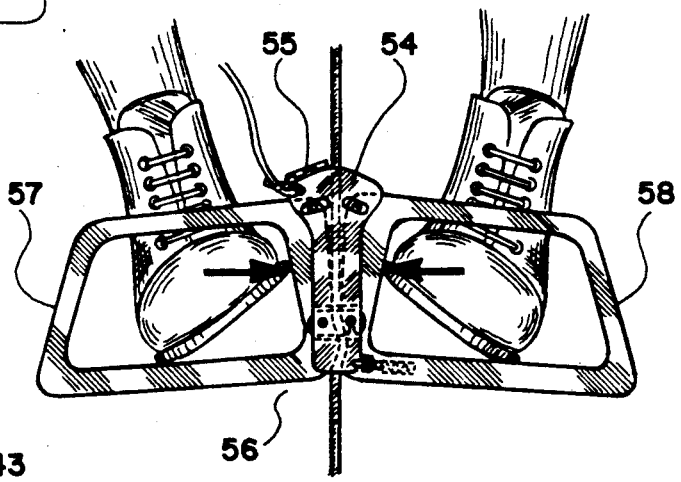
FIG. 3 illustrates a pair of foot-holds includes in the rope climbing and sliding device, that can be attached to or removed from the rope, as well as how to use the pair of foot-holds as a brake in controlling the descending speed.
Figure 4:
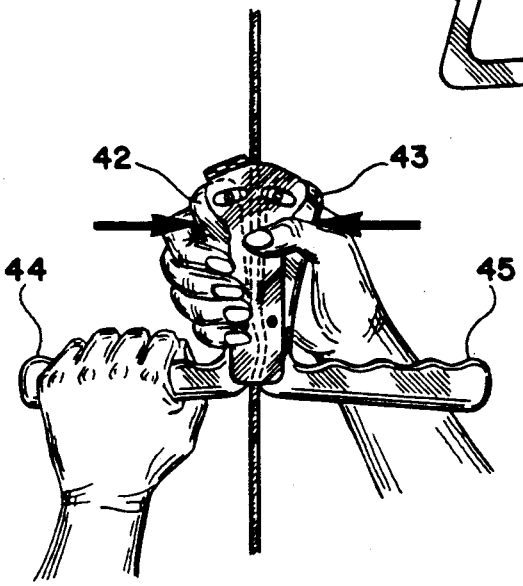
FIG. 4 illustrates how to use the pair of handles as a brake in controlling the descending speed.

In FIG. 3 there is illustrated a modified version of the stirrup 3 shown in FIG. 1, which modified version includes one of the two planar support 54 connected to the other planar support by a hinged joint 55, which combination has the same construction and same function as that of the pair of planar supports 37 and 38 shown and described in conjunction with FIG. 2. FIG. 3 also illustrates how to control the braking exerted by the stirrup 56, while resting the full or partial body weight of a person on the stirrup 56. By pushing the two foot holds 57 and 58 towards one another with the insteps of the feet at a varying degree of compression, while supporting the full or partial body weight on the outer portion of the feet, one can reduce the braking force whereby one slides down on the rope at a desired speed.

FIG. 4 illustrates how to control the braking force exerted by the handle 2 shown in FIG. 1 or the handle 40 shown in FIG. 2, which is accomplished by grabbing the two angled members 42 and 43 of the handles and compressing towards to one another at varying pressures, which action partially or completely reduces the braking exerted by the handle.

When the present invention is used as a fire escape from a high rise building, the vertically disposed rope may be permanently installed adjacent to the wall of the building in a number of appropriate locations, and a reasonably large number of the combination of the handle and harness should be stored next to the rope at different floors of the building. Of course, the handle must include the features shown in and described with FIG. 2 that allows the handle to be attached to or removed from the rope. The present invention packaged as a personal fire escape system should include a rope anchored to an appropriate floor and stored in a reeled-up state and the combination of the handle and harness.

While the principles of the present invention have now been made clear by the illustrative embodiments, there will be many modifications of the structures, arrangements, proportions, elements and materials obvious to those skilled in the art, which are particularly adapted to the specific working environments and operating conditions in the practice of the invention without departing from those principles. It is not desired to limit the inventions to the particular illustrated embodiments shown and described and, accordingly, all suitable modifications and equivalents may be regarded as falling within the scope of the inventions as defined by the claims which follows.

The embodiments of the invention, in which an exclusive property or priviledge is claimed, are defined as follows:

1. An apparatus for sliding down on a vertically disposed rope comprising in combination:

(a) a handle assembly including a pair of handles disposed on two opposite sides of the rope, each of said pair of handles including at least a first leg of sufficient length to be grabbed by a hand of a person disposed generally parallel and adjacent to the rope and a second leg disposed generally perpendicular to and extending away from the rope, wherein the rope is routed through a gap between the first legs of the pair of handles, and each of the pair of handles is secured to a support member disposed in an arrangement confining the rope within said gap in a pivoting relationship about a pivoting axis generally perpendicular to a plane including the first and second legs and located adjacent to an angular junction of the first and second legs; whereby the gap between the angular junctions included in the pair of handles narrows down and grabs the rope when the pair of handles are pulled down or the first legs included in the pair of handles are pulled apart from another, and opens up and allows the rope to slide when the pair of handles are pushed up or the first legs are compressed towards one another as a result of scissor action of the first legs included in the pair of handles about the respective pivoting axis; and (b) a harness securable around the body of a person depending from said handle assembly.

2. The combination as set forth in claim 1 wherein the gap between the angled junctions included in the pair of handles has a curved portion providing a curved passage for the rope, wherein said curved passage for the rope amplifies braking force exerted by the handle assembly, that grabs the rope.

3. The combination as set forth in claim 1 wherein said support member includes means for opening and closing passage of the rope in said gap, whereby the handle assembly can be attached to the rope in a sliding relationship or removed from the rope.

4. The combination as set forth in claim 1 wherein each of said first leg includes a motion limiting means disposed at an extremity of the first leg opposite to the angular junction of the first and second legs, wherein said motion limiting means limits pivoting motion of the first leg about the pivoting axis thereof to a limited angle.

5. The combination as set forth in claim 1 wherein the harness is secured to the handle assembly by a pair of cords extending from the harness and respectively secured to the pair of handles, whereby body weight of a person resting on the harness compresses the angled junctions of the pair of handles towards one another and produces a braking force slowing down descending speed of the person sliding down on the rope.

6. An apparatus for ascending and descending following a vertically disposed rope comprising in combination:

(a) a handle assembly including a pair of handles disposed on two opposite sides of the rope, each of said pair of handles including at least a first leg of sufficient length to be grapped by a hand of a person disposed generally parallel and adjacent to the rope and a second leg disposed generally perpendicular to and extending away from the rope, wherein the rope is routed through a gap between the first legs of the pair of handles, and each of the pair of handles is secured to a support member disposed in an arrangement confining the rope within said gap in a pivoting relationship about a pivoting axis generally perpendicular to a plane including the first and second legs and located adjacent to an angular junction of the first and second legs; whereby the gap between the angular junctions included in the pair of handles narrows down and grabs the rope when the pair of handles are pulled down or the first legs included in the pair of handles are pulled apart from another, and opens up and allows the rope to slide when the pair of handles are pushed up or the first legs are compressed towards one another as a result of scissor action of the first legs included in the pair of handles about the respective pivoting axis; and (b) a stirrup assembly including a pair of stirrups disposed on two opposite sides of the rope, each of said pair of stirrups including at least a first leg of sufficient length to be pushed by the insole of a foot of a person disposed generally parallel and adjacent to the rope and a second leg disposed generally perpendicular to and extending away from the rope, wherein the rope is routed through a gap between the first legs of the pair of stirrups, and each of the pair of stirrups is secured to a support member disposed in an arrangement confining the rope within said gap in a pivoting relationship about a pivoting axis generally perpendicular to a plane including the first and second legs and located adjacent to an angular junction of the first and second legs; whereby the gap between the angular junctions includes in the pair of stirrups narrows down and grabs the rope when the pair of stirrups are pushed down or the first legs included in the pair of stirrups are pulled apart from one another, and opens up and allows the rope to slide when the pair of stirrups are pulled up or the first legs are compressed towards one another as a result of scissor action of the first legs included in the pair of stirrups about the respective pivoting axis.

7. The combination as set forth in claim 6 wherein the gap between the angled junctions included in the pair of handles and gap between the angled junctions included in the pair of stirrups have a curved portion providing a curved passage for the rope, wherein said curved passage for the rope amplifies braking forces exerted by the handle assembly and the stirrup assembly, which grab the rope.

8. The combination as set forth in claim 6 wherein said support members included in the handle assembly and the stirrup assembly includes means for opening and closing passages of the rope in said gaps, whereby the handle assembly and the stirrup assembly can be attached to the rope in a sliding relationship and removed from the rope.

9. The combination as set forth in claim 6 wherein each of said first leg includes a motion limiting means disposed at an extremity of the first leg opposite to the angular junction of the first and second legs, wherein said motion limiting means limits pivoting motion of the first leg about the pivoting axis thereof to a limited angle.

10. The combination as set forth in claim 6 wherein said combination includes a harness securable around the body of a person that depends from the handle assembly.

11. The combination as set forth in claim 10 wherein the gap between the angled junctions included in the pair of handles and gap between the angled junctions included in the pair of stirrups have a curved portion providing a curved passage for the rope, wherein said curved passage for the rope amplifies braking forces exerted by the handle assembly and the stirrup assembly, which grab the rope.

12. The combination as set forth in claim 10 wherein said support members included in the handle assembly and the stirrup assembly include means for opening and closing passages of the rope in said gaps, whereby the handle assembly and the stirrup assembly can be attached to the rope in a sliding relationship and removed from the rope.

13. The combination as set forth in claim 10 wherein each of said first leg includes a motion limiting means disposed at an extremity of the first leg opposite to the angular junction of the first and second legs, wherein said motion limiting means limits pivoting motion of the first leg about the pivoting axis thereof to a limited angle.

14. The combination as set forth in claim 10 wherein the harness is secured to the handle assembly by a pair of cords extending from the harness and respectively secured to the pair of a ndles, whereby body weight of a person resting on the harness compresses the angled junctions of the pair of handles towards one another and produces a braking force slowing down descending speed of the person sliding down on the rope.

15. A handle assembly sliding on a rope comprising a pair of handles disposed on two opposite sides of the rope, each of said pair of handles including at least a first leg of sufficient length to be grabbed by a hand of a person disposed generally parallel and adjacent to the rope and a second leg disposed generally perpendicular to and extending away from the rope, wherein the rope is routed through a gap between the first legs of the pair of handles, and each of the pair of handles is secured to a support member disposed in an arrangement confining the rope within said gap in a pivoting relationship about a pivoting axis generally perpendicular to a plane including the first and second legs and located adjacent to an angular junction of the first and second legs; whereby the gap between the angular junctions included in the pair of handles narrows down and grabs the rope when the pair of handles are pulled down or the first legs included in the pair of handles are pulled apart from another, and opens up and allows the rope to slide when the pair of handles are pushed up or the first legs are compressed towards one another as a result of scissor action of the first legs included in the par of handles about the respective pivoting axis.

16. The combination as set forth in claim 15 wherein the gap between the angled junctions included in the pair of handles has a curved portion providing a curved passage for the rope, wherein said curved passage for the rope amplifies braking force exerted by the handle assembly, that grabs the rope.

17. The combination as set forth in claim 15 wherein said support member includes means for opening and closing passage of the rope in said gap, whereby the handle assembly can be attached to the rope in a sliding relationship or removed from the rope.

18. A stirrup assembly sliding on a rope comprising a pair stirrups disposed on two opposite sides of the rope, each of said pair of stirrups including at least a first leg of sufficient length to be pushed by the insole of a foot of a person disposed generally parallel and adjacent to the rope and a second leg disposed generally perpendicular to and extending away from the rope, wherein the rope is routed through a gap between the first legs of the pair of stirrups, and each of pair of stirrups is secured to a support member disposed in an arrangement confining the rope within said gap in a pivoting relationship about a pivoting axis generally perpendicular to a plane including the first and second legs and located adjacent to an angular junction of the first and second legs; whereby the gap between the angular junctions included in the pair of stirrups narrows down and grabs the rope when the pair of stirrups are pushed down or the first legs included in the pair of stirrups are pulled apart from one another, and opens up and allows the rope to slide when the pair of stirrups are pulled up or the first legs are compressed towards one another as a result of scissor action of the first legs included in the pair of stirrups about the respective pivoting axis.

19. The combination as set forth in claim 18 wherein the gap between the angled junctions included in the pair of stirrups has a curved portion providing a curved passage for the rope, wherein said curved passage for the rope amplifies braking force exerted by the stirrup assembly, that grabs the rope.

20. The combination as set forth in claim 18 wherein said support member includes means for opening and closing passage of the rope in said gap, whereby the stirrup assembly can be attached to the rope in a sliding relationship or removed from the rope.

* * * * *